US008579660B2

(12) United States Patent
Chow et al.

(10) Patent No.: US 8,579,660 B2
(45) Date of Patent: Nov. 12, 2013

(54) HIGH SPEED MODULAR JACK

(75) Inventors: John Chow, Saratoga, CA (US); Yueh-Shan Shih, New Taipei (TW); Zhi-Cheng Zhang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 229 days.

(21) Appl. No.: 13/160,557

(22) Filed: Jun. 15, 2011

(65) Prior Publication Data

US 2011/0306240 A1 Dec. 15, 2011

(51) Int. Cl.
*H01R 13/648* (2006.01)

(52) U.S. Cl.
USPC ..... 439/607.01; 439/540.1; 439/676

(58) Field of Classification Search
USPC ..... 439/607.01, 676, 540.1, 541.5, 607.23
See application file for complete search history.

(56) References Cited

U.S. PATENT DOCUMENTS

| | | | | |
|---|---|---|---|---|
| 5,190,462 | A | 3/1993 | Lauchner | |
| 5,639,267 | A | 6/1997 | Loudermilk | |
| 6,238,245 | B1 | 5/2001 | Stokoe | |
| 6,511,348 | B1 * | 1/2003 | Wojtacki et al. | 439/620.18 |
| 6,623,307 | B2 | 9/2003 | Korsunsky | |
| 6,655,988 | B1 | 12/2003 | Simmons et al. | |
| 6,659,807 | B1 | 12/2003 | Zheng et al. | |
| 7,153,158 | B1 * | 12/2006 | Lee | 439/541.5 |
| 7,510,441 | B2 * | 3/2009 | Zhang et al. | 439/620.18 |
| 7,588,457 | B2 * | 9/2009 | Zhang | 439/490 |
| 7,670,172 | B2 | 3/2010 | Zhang et al. | |
| 7,674,136 | B2 | 3/2010 | Steinke et al. | |
| 7,775,828 | B2 * | 8/2010 | Zhang | 439/540.1 |
| 8,215,982 | B2 * | 7/2012 | Bu et al. | 439/490 |
| 8,337,246 | B2 * | 12/2012 | Zhang | 439/607.01 |
| 2005/0282432 | A1 * | 12/2005 | Murr et al. | 439/540.1 |
| 2009/0098766 | A1 * | 4/2009 | Steinke et al. | 439/541.5 |
| 2009/0253293 | A1 * | 10/2009 | Zhang | 439/541.5 |
| 2011/0306242 | A1 * | 12/2011 | Zhang | 439/607.01 |
| 2012/0142199 | A1 * | 6/2012 | Purkis et al. | 439/39 |
| 2012/0196458 | A1 * | 8/2012 | Zhang et al. | 439/95 |
| 2012/0196478 | A1 * | 8/2012 | Zhang et al. | 439/607.01 |
| 2012/0196479 | A1 * | 8/2012 | Chow et al. | 439/607.35 |

* cited by examiner

*Primary Examiner* — Hae Moon Hyeon
(74) *Attorney, Agent, or Firm* — Ming Chieh Chang; Wei Te Chung

(57) ABSTRACT

A modular jack (100) comprising a housing (200) defining an upper cavity and a lower cavity vertically stacked under the upper port, and a contact module (400) assembled to the housing. The contact module further comprises an upper row of mating contacts (42) extending into the upper cavity for mating with a module plug inserted therein, a horizontal upper PCB (43) bearing the upper row of contacts, a vertical right PCB (47) electrically connecting the upper PCB, a number of right transferring contacts (524) electrically connecting the right PCB, a lower row of mating contacts (44) extending into the lower cavity for mating with another module plug inserted therein, a horizontal lower PCB (45) bearing the lower row of contacts, a vertical left PCB (46) electrically connecting the lower PCB, a number of left transferring contacts (522) electrically connecting the left PCB.

20 Claims, 14 Drawing Sheets

HIGH SPEED MODULAR JACK

BACKGROUND OF THE INVENTION

This application is one of three patent applications having a same title of "HIGH SPEED MODULAR JACK" and being filed on a same date.

Field of the Invention

The present invention relates to modular jack, and particularly, to a high speed modular jack having stacked mating ports.

Description of Related Art

U.S. Pat. No. 6,655,988, issued to Simmons et al. on Dec. 2, 2003, discloses a stacked jack modular jack assembly having a multi-port housing. The assembly includes the housing, a plurality of jack modules, a plurality of LEDs (Light Emitting Diodes), and a plurality of LED modules. The jack module 10 includes an outer insulating housing holding a jack subassembly. The jack subassembly comprises an upper jack portion, an intermediate shield, and a lower jack portion, a lower housing portion, two vertical component boards, and a vertical shield member disposed between the two vertical component boards.

U.S. Pat. No. 6,659,807, issued to Zheng et al. on Dec. 9, 2003, discloses another multiport modular jack. The modular jack has an insulating housing and a plurality of jack subassemblies. Each jack subassembly has a base member, a first and second horizontal printed circuit boards (PCB), a pair of insert portions mounted on corresponding PCBs, and a plurality of terminals insert molded in the insert portions. One of the insert portions has a plurality of first positioning posts and first mounting holes, the other insert portion has a plurality of second positioning posts and mounting holes second stably engaging with the first mounting holes and the first positioning posts.

U.S. Pat. No. 6,511,348, issued to Wojtacki et al. on Jan. 28, 2003, discloses another multiport modular jack. The modular jack comprises an outer housing and a plurality of modular jack subassemblies. The modular jack subassemblies are comprised of an elongate beam support having a plurality of modular jack contacts on both sides thereof. The contacts extend into printed circuit board contacts and extend to and beyond the side edges of the elongate beam support, leaving the space above and below the printed circuit board contacts and the beam support free, to accommodate signal conditioning component. Two printed circuit board modules are mounted orthogonally to the side edges of the beam support and include signal conditioning components. A vertical shield plate is interposed between two adjacent subassemblies.

Such multi-port connectors are used for networks and operated at high rates of one gigabyte and higher so that excellent conditioning of the signals to be transferred is required. Shielding is therefore normally necessary in order for example to provide a so-called Common Mode Rejection (CMR) and to guarantee a specified electromagnetic compatibility (EMC) and/or resistance to electromagnetic disturbance. For the purpose of conditioning the signals it is therefore further necessary to incorporate within the arrangement corresponding components such as particularly magnet coils but also capacitive components in order to correspondingly condition the signals.

An object of the invention consequently consists of providing a new and substantially improved modular jack connector structure with respect to the prior art and particularly for use in the case of Ethernet networks so as to provide a modular jack connector with complete shielding between any two adjacent ports and required signals conditioning.

SUMMARY OF THE INVENTION

In accordance with the invention, a modular jack connector is therefore provided adapted to be mounted onto a horizontal mother PCB. The modular jack comprises a housing defining an upper port and a lower port vertically stacked under the upper port, and a contact module assembled to the housing. The contact module further comprises an upper row of mating contacts extending into the upper port for mating with a module plug inserted therein, a horizontal upper PCB bearing the upper row of contacts, a vertical right PCB electrically connecting the upper PCB, a plurality of right transferring contacts electrically connecting the right PCB to the horizontal mother PCB, a lower row of mating contacts extending into the lower port for mating with another module plug inserted therein, a horizontal lower PCB bearing the lower row of contacts, a vertical left PCB electrically connecting the lower PCB, a plurality of left transferring contacts electrically connecting the left PCB to the horizontal mother PCB.

In accordance with the invention, another modular jack connector is therefore provided to be mounted onto a horizontal mother PCB. The modular jack comprises a housing defining an upper port and a lower port vertically stacked under the upper port; and a contact module assembled to the housing. The contact module further comprises an upper row of mating contacts extending into the upper port for mating with a module plug inserted therein, a vertical right PCB electrically connecting the upper mating contacts, a plurality of right transferring contacts for electrically connecting the right PCB to the horizontal mother PCB, a lower row of mating contacts extending into the lower port for mating with another module plug inserted therein, a vertical left PCB electrically connecting the lower mating contacts, a plurality of left transferring contacts for electrically connecting the left PCB to the horizontal mother PCB, a left plastic body supporting the left PCB, a right plastic body supporting the right PCB, and a vertical shield plate sandwiched between the left plastic body and the right plastic body.

Other objects, advantages and novel features of the invention will become more apparent from the following detailed description of a preferred embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
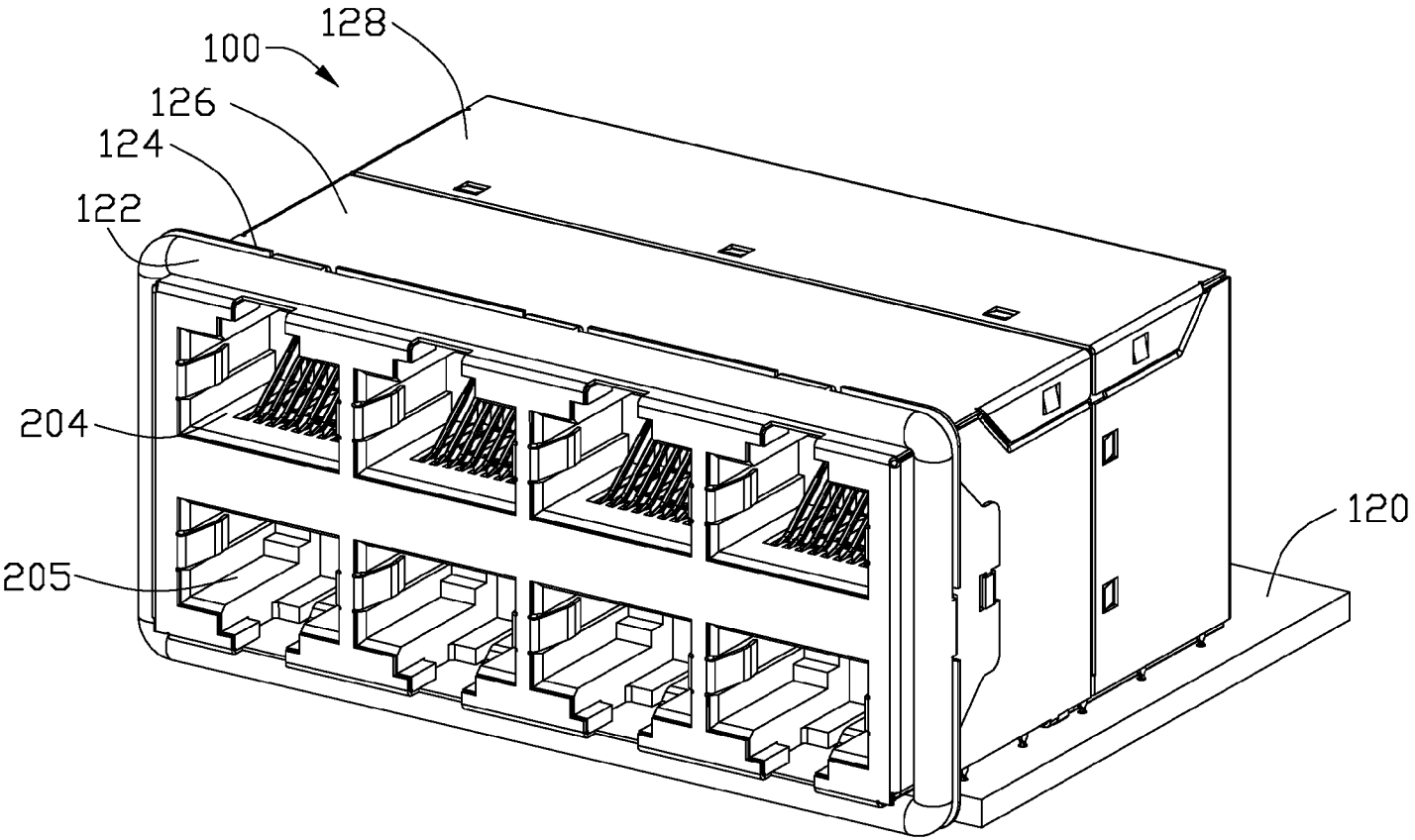
FIG. 1 is a perspective view of a stacked modular jack according to the present invention, mounted on a horizontal mother PCB.

Reference will now be made to the drawing figures to describe the present invention in detail.

Referring to FIG. 1, a perspective view of a 2×4-port modular jack 100 is shown. The modular jack 100 is used to be mounted on a horizontal printed circuit board 120 (horizontal mother PCB). The modular jack 100 has an upper row of ports 204 and a lower row of ports 205, each of which is used to receive a modular plug (not shown) with a high speed of 10 Gigbit/second. The modular jack 100 is covered with an outer metal shell including a front outer shell 126 and a rear outer shell 128. The front outer shell 126 is equipped with a bracket board 124 and a gasket 122 of a conductive rubber supported by the bracket board 124. The gasket 122 surrounds the front end of modular jack 100. When the modular jack 100 is mounted into a panel (not shown), the gasket 122 is pressed between the bracket board 124 and the panel.

Figure 2:
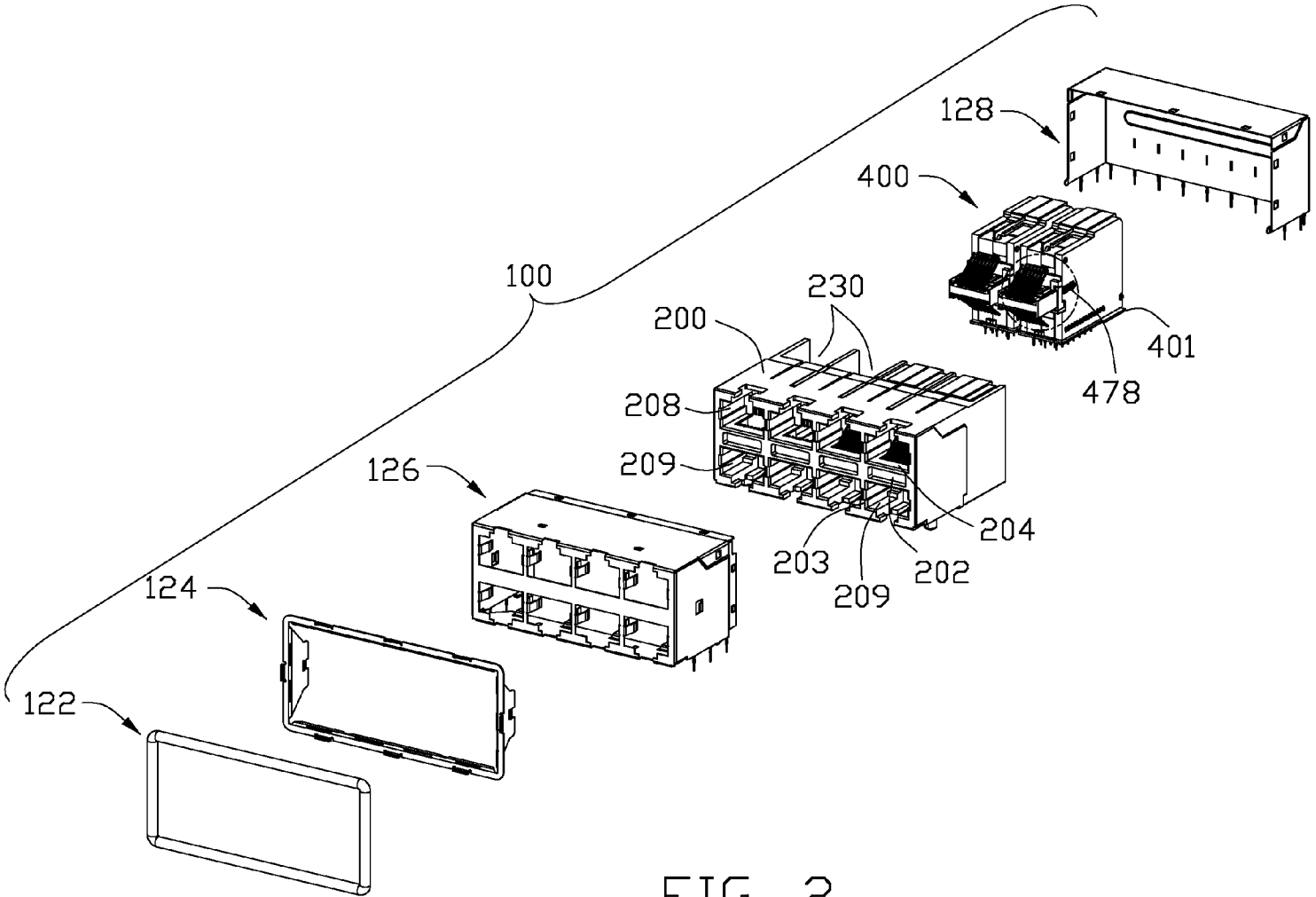
FIG. 2 is a partly exploded view of the modular jack shown in FIG. 1.
Figure 3:
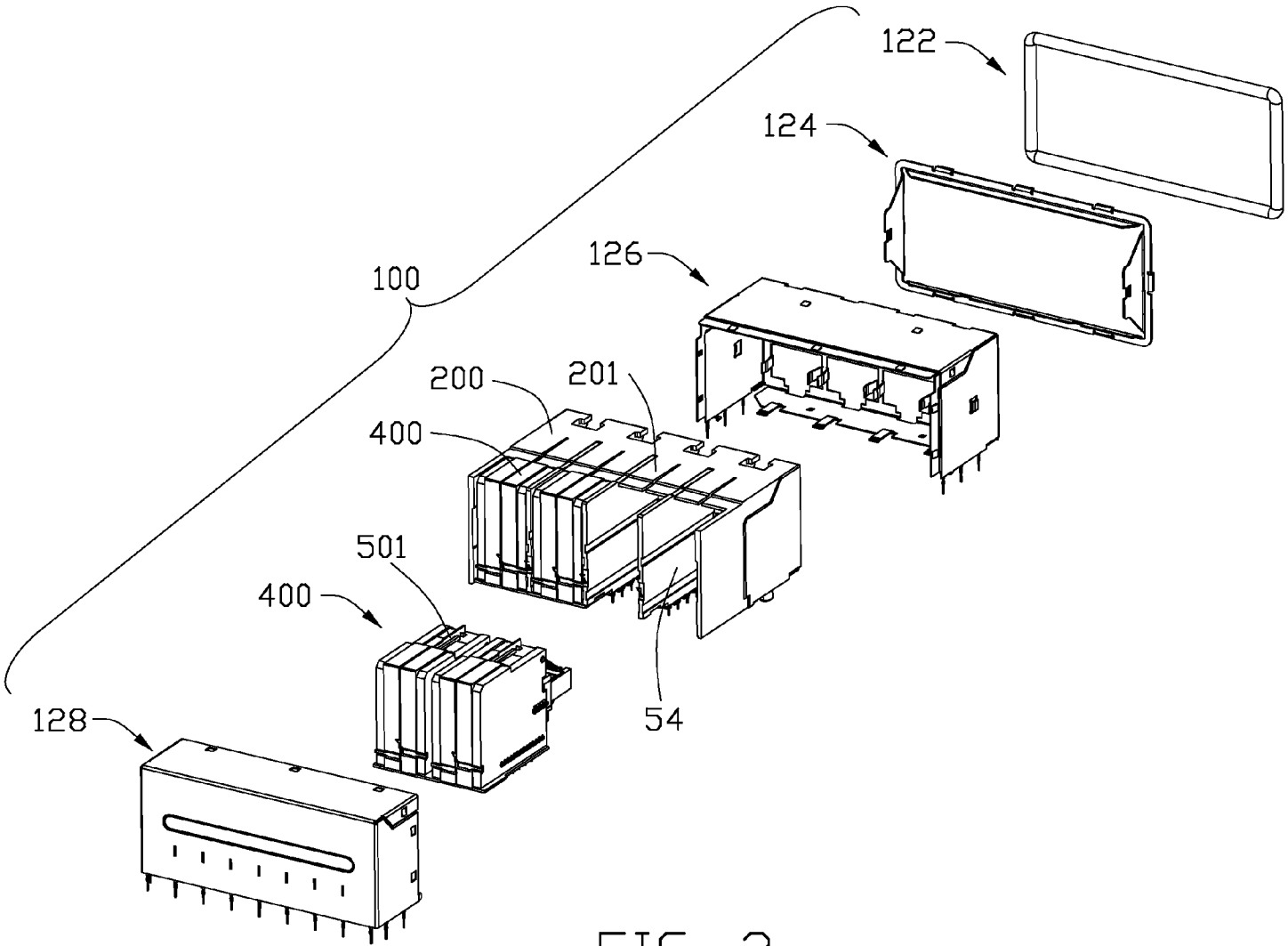
FIG. 3 is another partly exploded view of the modular jack shown in FIG. 1.
Figure 4:
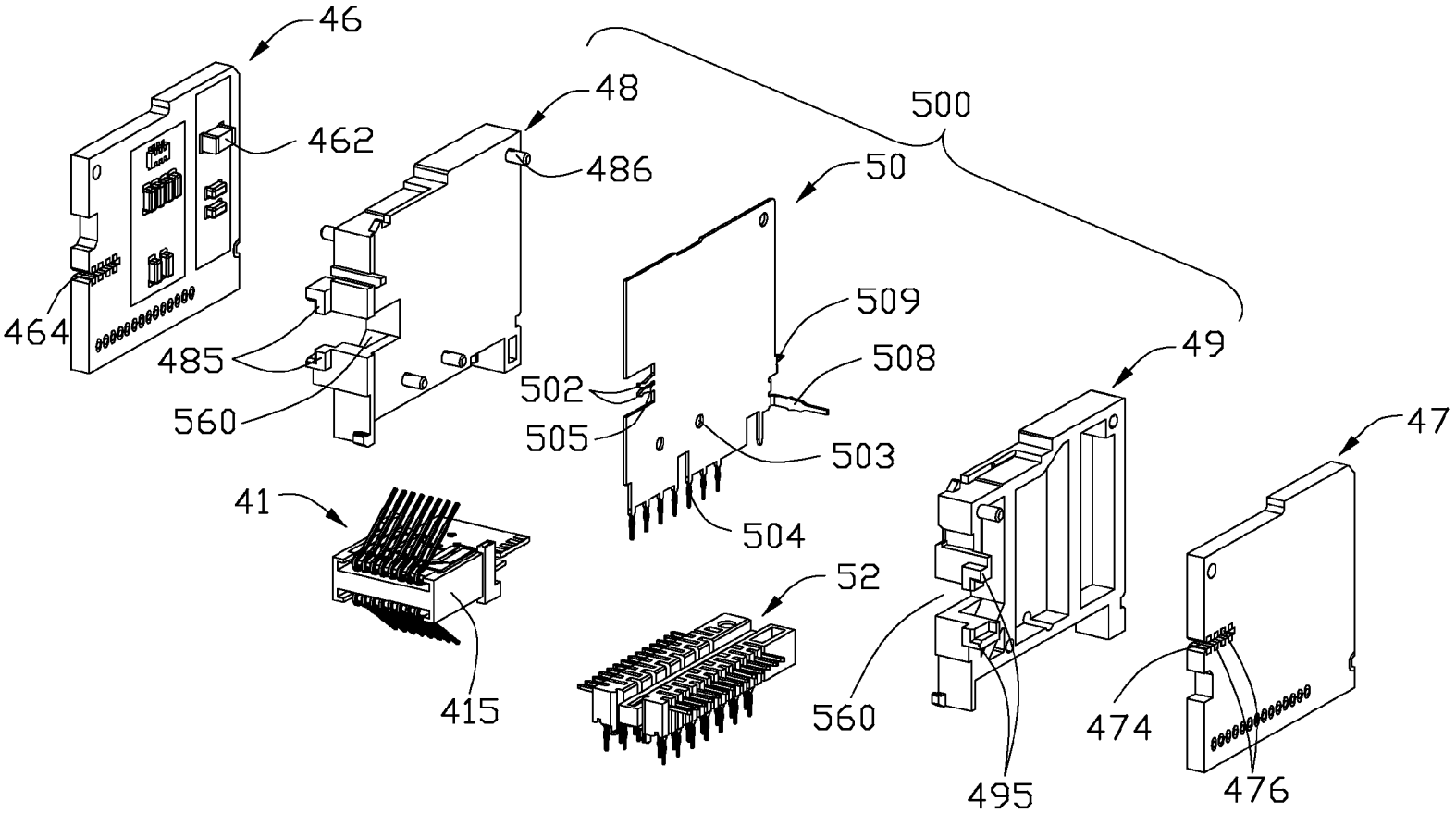
FIG. 4 is a partly exploded view of the contact module shown in FIG. 2.

Referring to FIGS. 2-4, the modular jack 100 further comprises a insulating housing 200, four contact modules 400, and three shield modules 54. It is preferred that two of the contact modules 400 are assembled into a contact subassembly with a bottom printed circuit board 401. Each contact module 400 comprises a center bracket 500, a transferring module 52, a left printed circuit board 46, a right printed circuit board 47, and a mating module 41.

Figure 5:
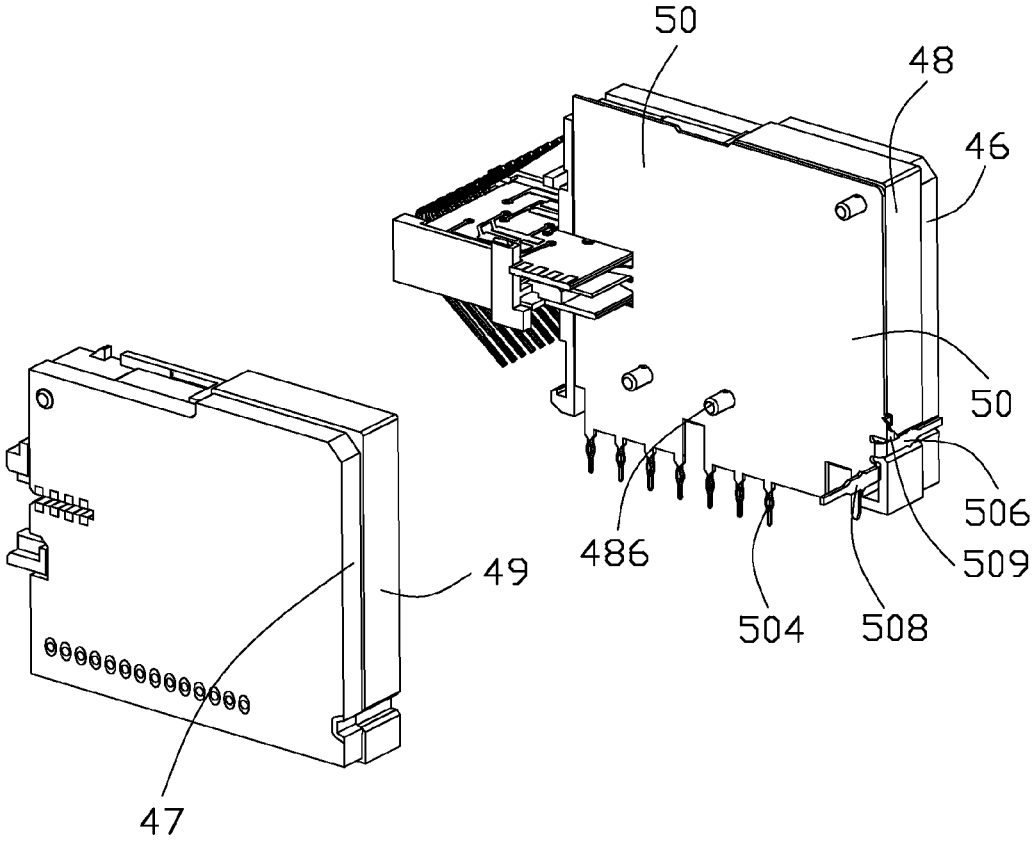
FIG. 5 is another partly exploded view of the contact module shown in FIG. 2.
Figure 6:
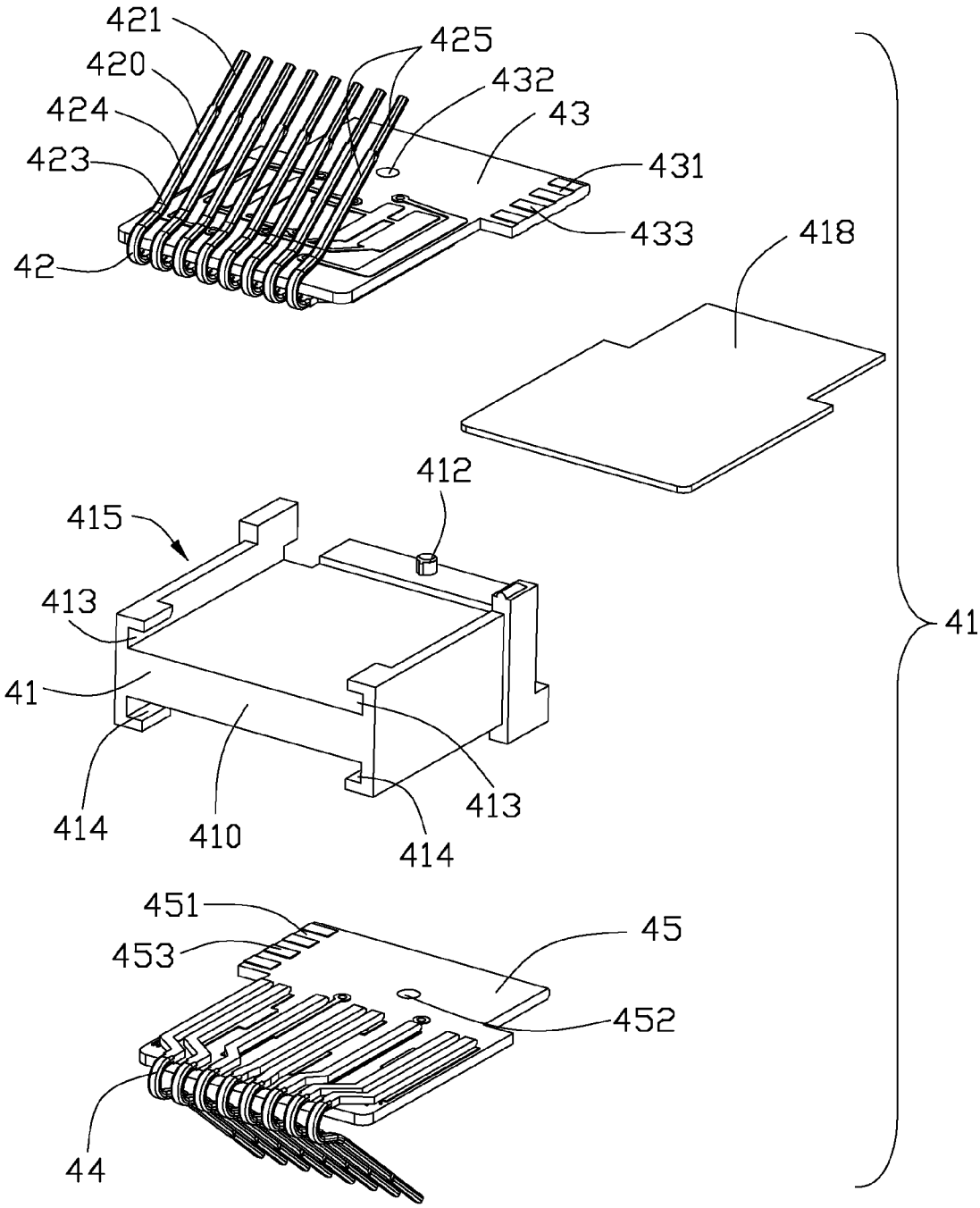
FIG. 6 is a partly exploded view of the mating contact module shown in FIG. 4.
Figure 7:
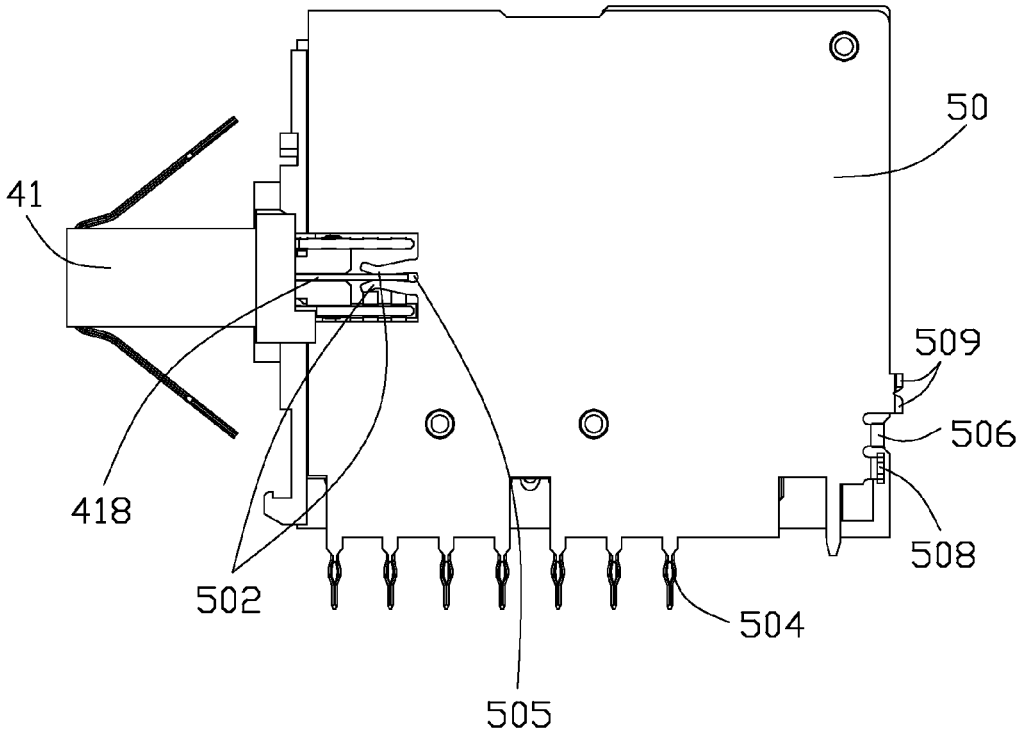
FIG. 7 is a side view of the contact module shown in FIG. 4, with part of components removed therefrom.

Referring to FIGS. 4-6, the mating module 41 comprises an upper set of mating contacts 42, a lower set of mating contacts 44, an upper PCB 43 bearing the upper set of mating contacts 42, a lower PCB 45 bearing the lower set of mating contacts 44, a front plastic body 415 bearing the upper PCB 43 and the lower PCB 45, and a horizontal shield plate 418 forwardly inserted into a slot (not shown) defined in the front plastic body 415 between the upper PCB 43 and the lower PCB 45, wherein the upper PCB 43 and the upper set of mating contacts 42 form an upper sub-mating module (not labeled), and wherein the lower PCB 45 and the lower set of mating contacts 44 form a lower sub-mating module (not labeled). The upper PCB 43 and the lower PCB 45 are designed with circuits for balancing crosstalk between signal channels in the same port.

The front plastic body 415 is unitarily injection molded with a horizontal board 410. The horizontal board 410 has opposite top face and bottom face. The front plastic body 415 forms two upper guide slots 413 laterally opening face to face and an upper post 412 on the top face, and two lower guide slots 414 laterally opening face to face and a lower post (not shown) on the bottom face. When the upper circuit board 43 is assembled to the front plastic body 415, the upper circuit board 43 is obliquely sliding onto the top under the guide of the guide slots 413 and then positioned by engagement of the upper post 412 into a positioning hole 432 defined in the upper circuit board 43. When the lower circuit board 45 is assembled to the front plastic body 415, the lower circuit board 45 is obliquely sliding onto the bottom face under the guide of the guide slots 414 and then positioned by engagement of the lower post into a positioning hole 452 defined in the lower circuit board 45.

Referring to FIGS. 4-5 and 7-8, the center bracket 500 includes a vertical shield plate 50, a left plastic body 48 and a right plastic body 49 sandwich the vertical shield plate 50; the center bracket 500 substantially forms another shield module. The left plastic body 48 has three fastening posts 486 and the right plastic body 49 and the vertical shield plate 50 define three holes 503 for holding the fastening posts 486. The vertical shield plate 50 forms a pair of spring arms 502 extending forwardly. The pair of spring arms 502 define a slot 505 (shown in FIGS. 4 and 7) therebetween and engage the horizontal shield plate 418. The vertical shield plate 50 further forms a plurality of grounding tails 504 for connecting the horizontal mother PCB 120, a left arm 506 connecting the left PCB 46 and a right arm 508 connecting the right PCB 47. The vertical shield plate 50 forms a pair of project tips 509 extending rearward through the rear outer shell 128 and then are riveted oppositely laterally for fixing the rear outer shell 128. The center bracket 500 has a front slot 560 receiving the mating module 41 therein. The front slot 560 has a pair of side walls (not labeled). The side walls have protrusions 485, 495 in front of the left PCB 46 and the right PCB 47. The protrusions 485, 495 mate with the mating module 41.

The vertical shield plate 50 has a marginal edge being scaled as possible so that the crosstalk is better shielded between the upper ports 204 and the lower ports 205. In the present embodiment, the marginal edge extends beyond the marginal edges of the left PCB 46 and the right PCB 47 in all directions. The vertical shield plate 50 has an upper edge 501 (shown in FIG. 8) extending along upwardly beyond a top face of the contact module 400 and reaching the outer shell 126, 128. The housing 200 defines four top slots 201 each to receive the upper edge 501 of the vertical shield plate 50 (shown in FIGS. 3 and 8).

The left PCB 46 and the right PCB 47 sandwich opposite sides of the center bracket 500. The left PCB 46 and the right PCB 47 have interior faces facing to each other and a plurality of electronic components 462 mounted thereon. The left plastic body 48 defines cavities receiving the electronic components 462 on the left PCB 46. The left PCB 46 defines a lower slot 464 opening forwardly and receiving a left edge 451 of the lower PCB 45. A plurality of conductive pads 453 are disposed on opposite surface of the lower PCB 45 and lined along the left edge 451. A corresponding number of conductive pads (not shown) are disposed along opposite sides of the lower slot 464 on an exterior face of the left PCB 46. A number of connecting conductors 468 electrically connect the conductive pads 453 of the lower PCB 45 to the conductive pads of the left PCB 46. The right plastic body 49 defines cavities receiving the electronic components on the right PCB 47. The right PCB 47 defines an upper slot 474 opening forwardly and receiving a right edge 431 of the upper PCB 43. A plurality of conductive pads 433 are disposed on opposite surface of the lower PCB 43 and lined along the left edge 431. A corresponding number of conductive pads 476 are disposed along opposite sides of the upper slot 474 on an exterior face of the right PCB 47. A number of connecting conductors 478 electrically connect the conductive pads 433 of the upper PCB 43 to the conductive pads 476 of the right PCB 47.

It is noted that as an alternative embodiment of the present invention, the upper PCB 45 and the left PCB 46 are redesigned to be electrically connected, and the lower PCB 43 and the right PCB 47 are redesigned to be electrically connected.

Figure 8:
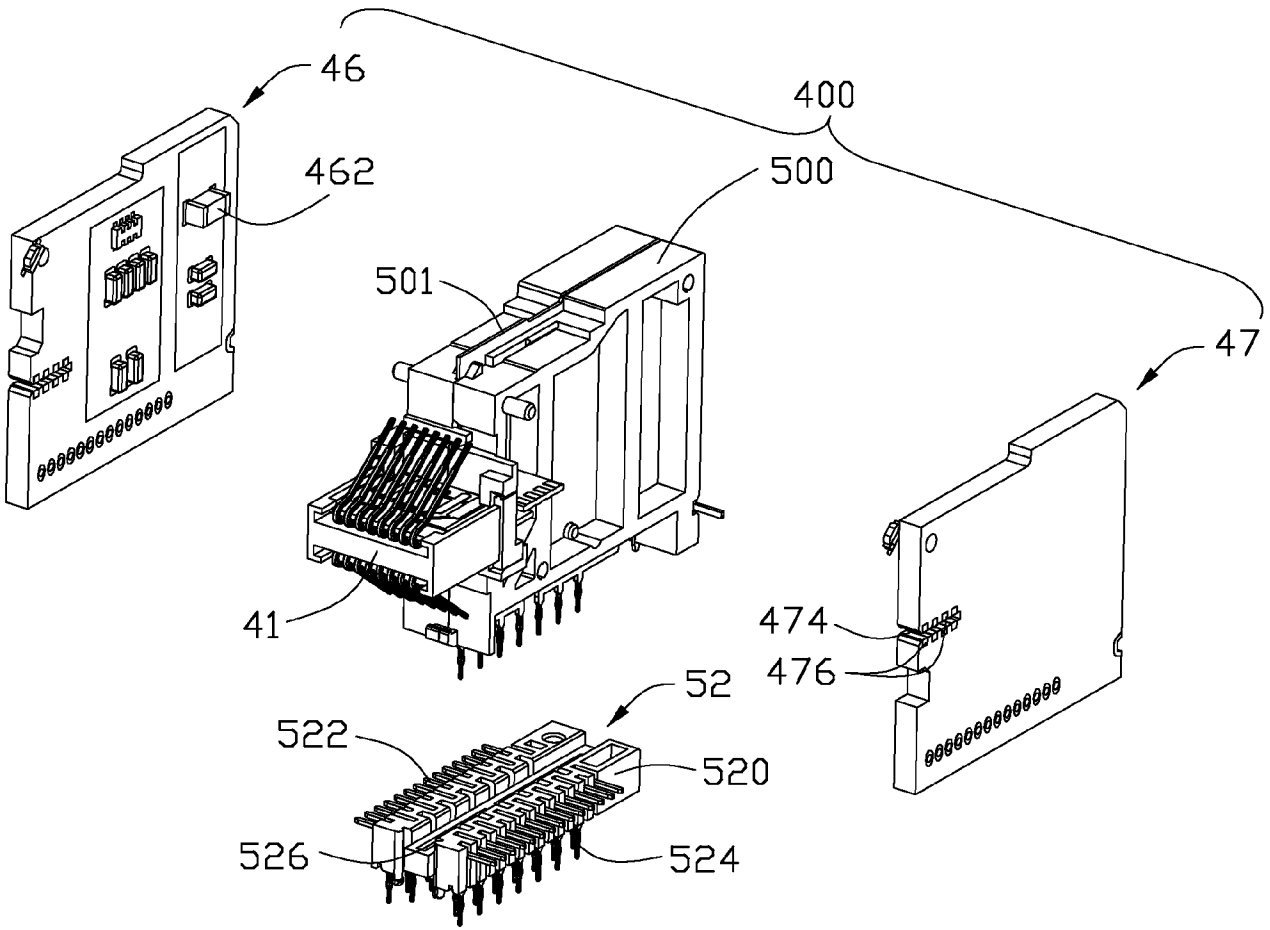
FIG. 8 is still another partly exploded view of the contact module shown in FIG. 2.
Figure 9:
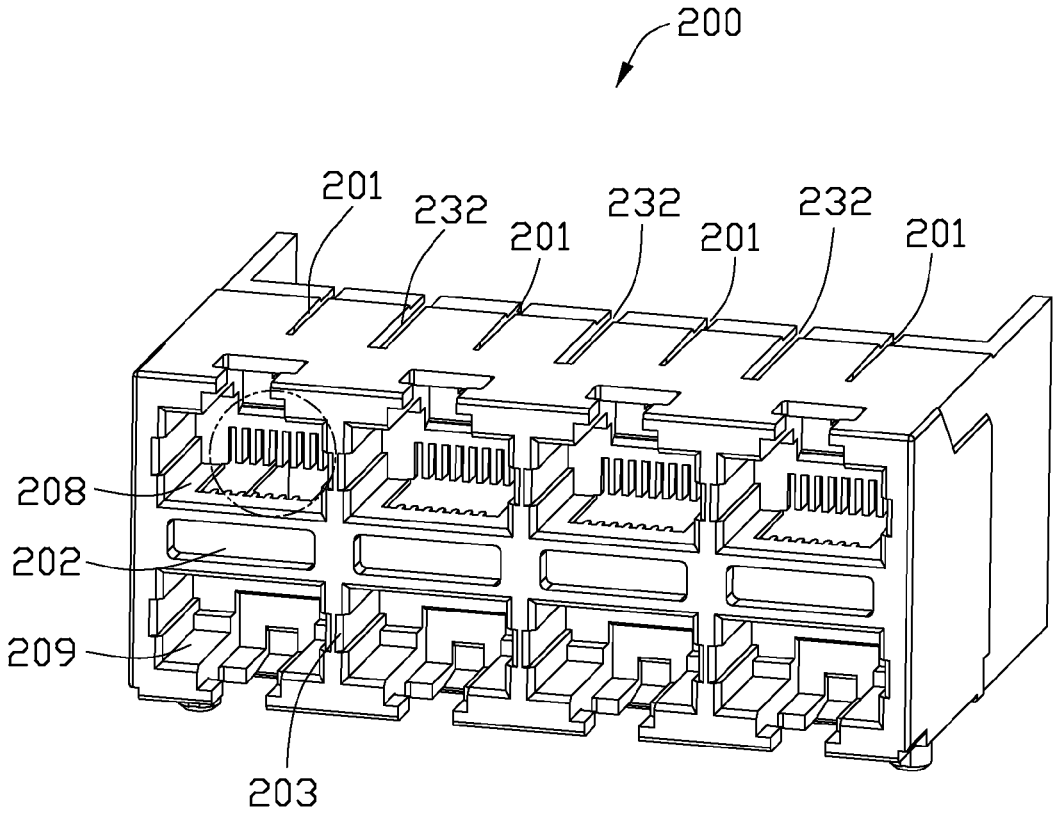
FIG. 9 is a perspective view of the housing shown in FIG. 2.
Figure 10:
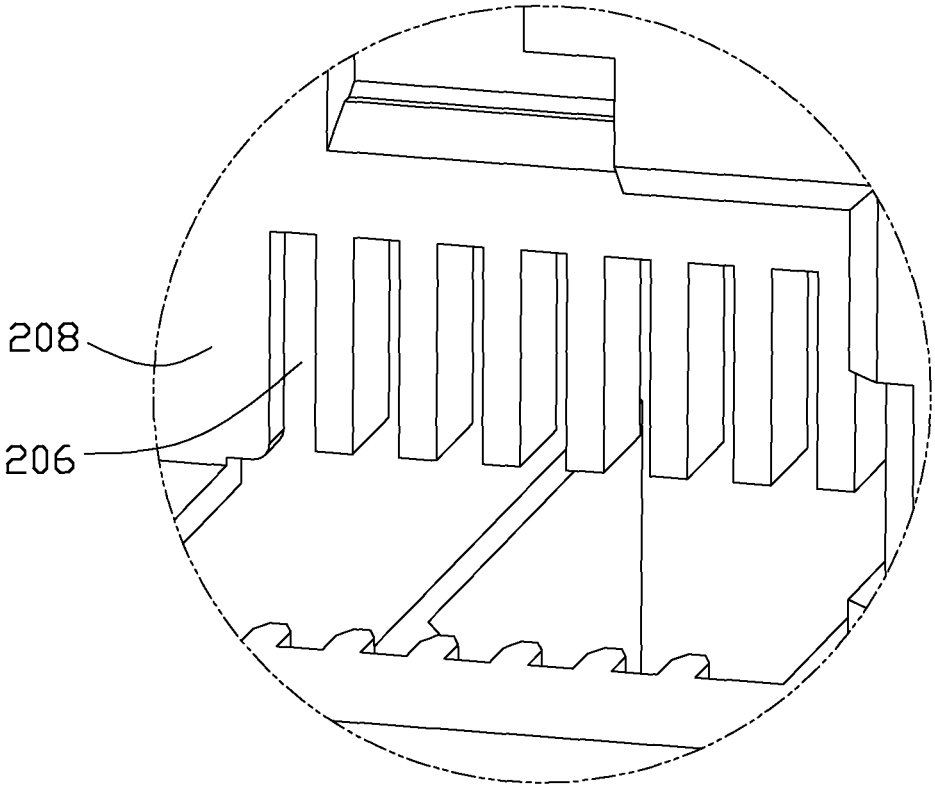
FIG. 10 is a scaled view of a circled portion shown in FIG. 9.
Figure 11:
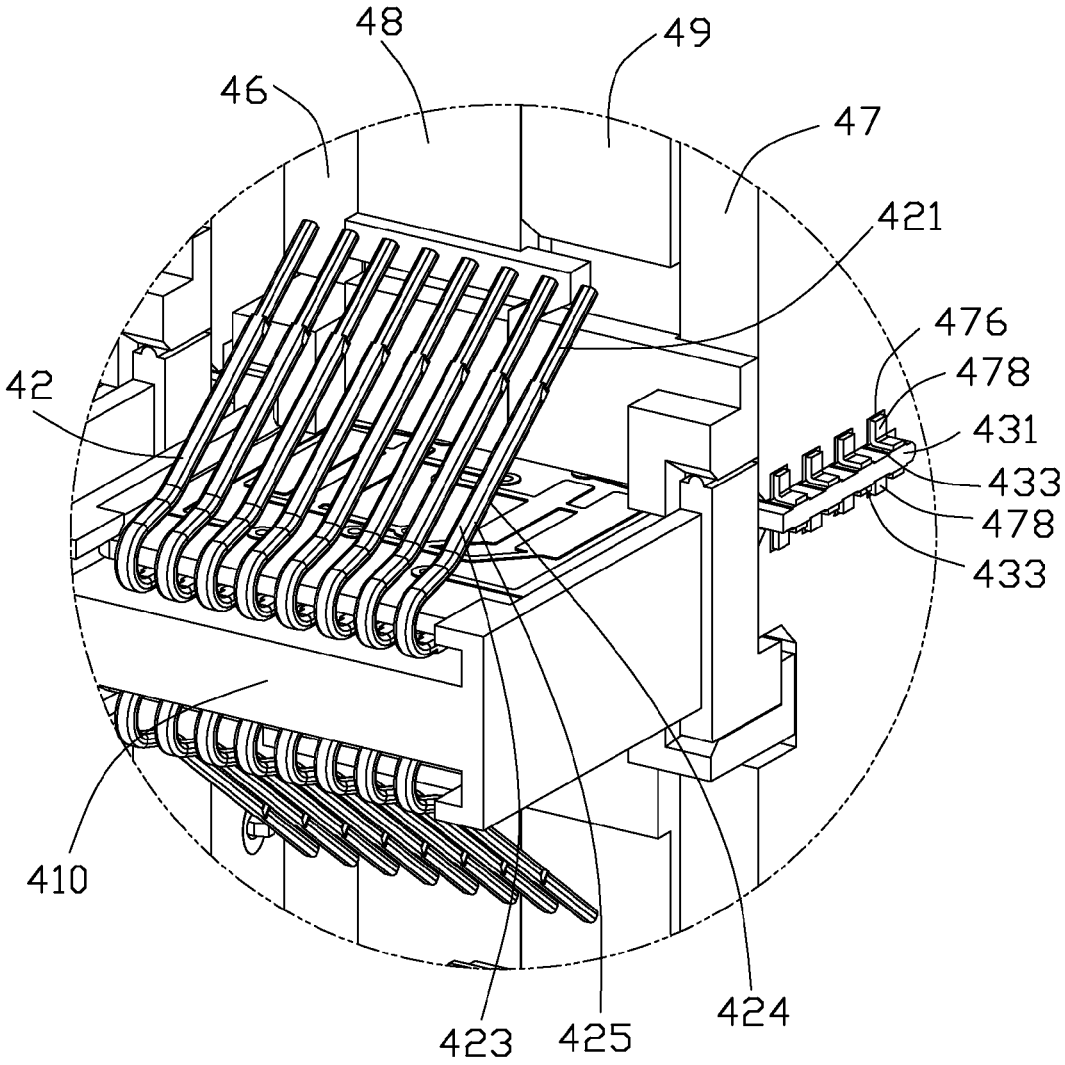
FIG. 11 is a scaled view of a circled portion shown in FIG. 2.

Referring to FIG. 8, the transferring module 52 comprises a plurality of left transferring contacts 522 electrically connecting the left PCB 46 to the horizontal mother PCB 120, a plurality of right transferring contacts 524 electrically connecting the right PCB 47 to the horizontal mother PCB 120, and a bottom plastic body 520 fixing the left transferring contacts 522 and the right transferring contacts 524. The bottom plastic body 520 defines a slot 526 between the left transferring contacts 522 and the right transferring contacts 524. The shield plate 50 extends downwardly through the slot 526 and the ground tails 504 continue extending there from.

Referring to FIGS. 6 and 9-11, the insulating housing 200 defines 2×4 cavities 208, 209 to form the 2×4 ports 204, 205 of the modular jack 100 and four rear receiving spaces 230 (labeled in FIG. 2). The upper row of cavities 208 and the lower row of cavities 209 are separated by a horizontal wall 202. Any adjacent two columns of cavities 208, 209 are separated by a vertical wall 203. The insulating housing 200 defines three slots 232 in the vertical walls 203 respectively to receive the shield modules 54, specifically, a front portion of the shield modules 54 including a front portion of the shield plate 548, wherein the three shield modules 54 separate the four rear receiving spaces 230 (shown in FIGS. 2, 3, 9 and 14). The insulating housing 200 forms eight slots 206 behind each of the cavities 208, 209. The mating contacts 42, 44 are fixed to the horizontal wall 202. Each of the mating contacts 42, 44 comprises a contacting arm 420 and a tapered free end 421 (see FIGS. 6 and 11). The free ends 421 are received in respective slots 206. The mating contacts 42, 44 are formed and punched from a sheet material. Each of the mating contacts 42, 44 has two smooth surfaces 423 and two punched surfaces 424. Each of the mating contacts 42, 44 forms two round front corners 425 connecting a front smooth surface 423 and two punched surfaces 424, so that when the contact module 400 are inserted into the insulating housing 200, scratch to the housing 200 and the chance of damage to the mating contacts 42, 44 is greatly decreased.

Figure 12:
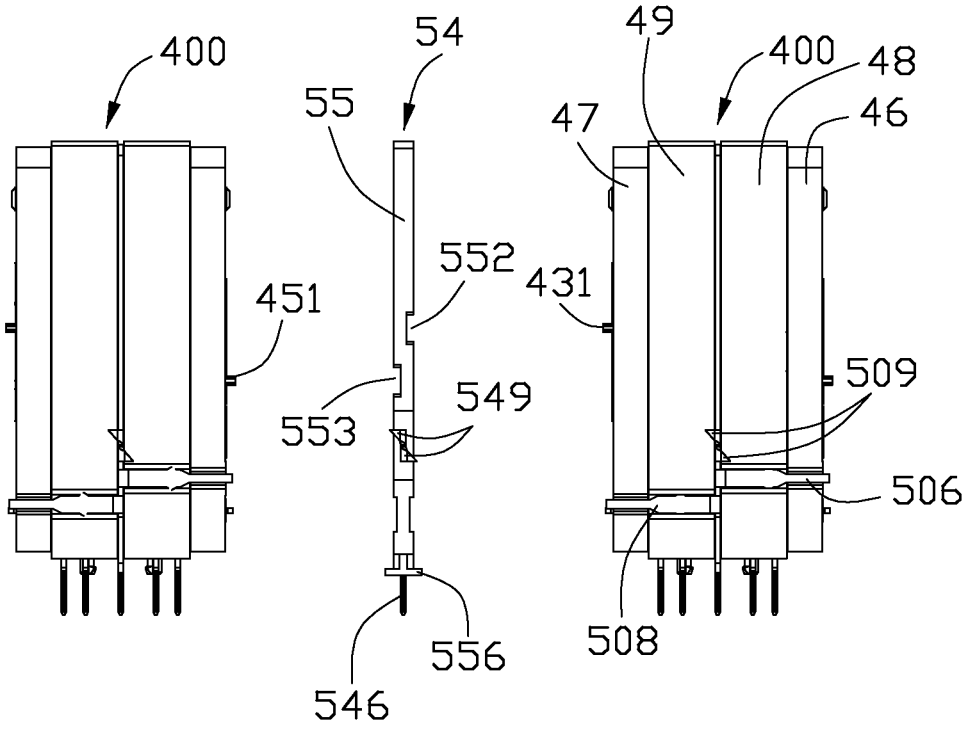
FIG. 12 is a back view of two contact modules and a shield module shown in FIG. 2, with each aligned separated position in a horizontal direction.
Figure 13:
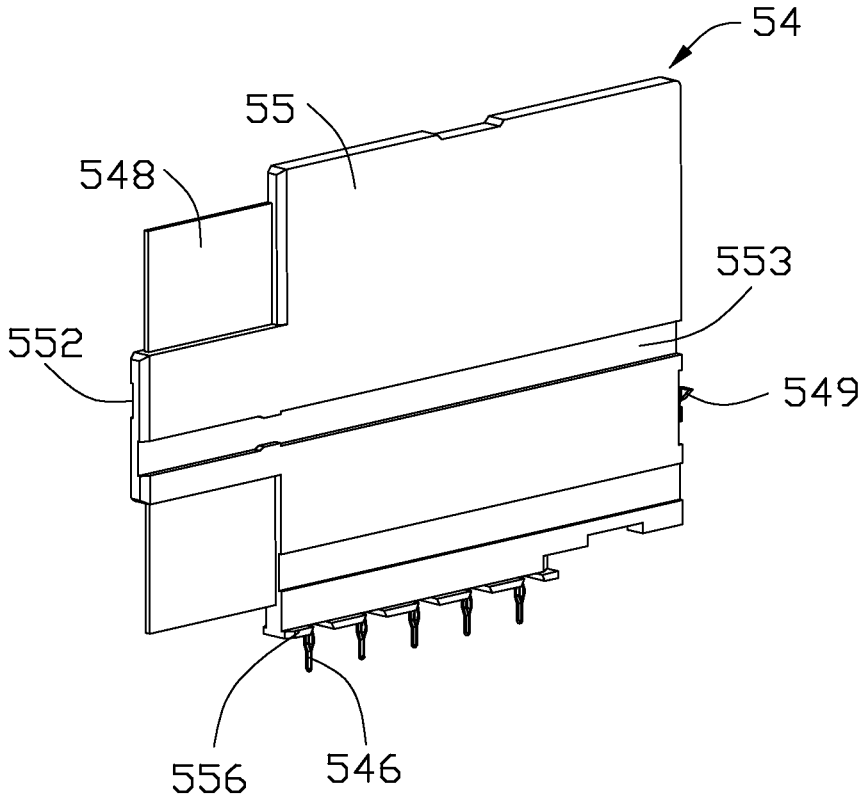
FIG. 13 is a perspective view of the shield module shown in FIG. 12.
Figure 14:
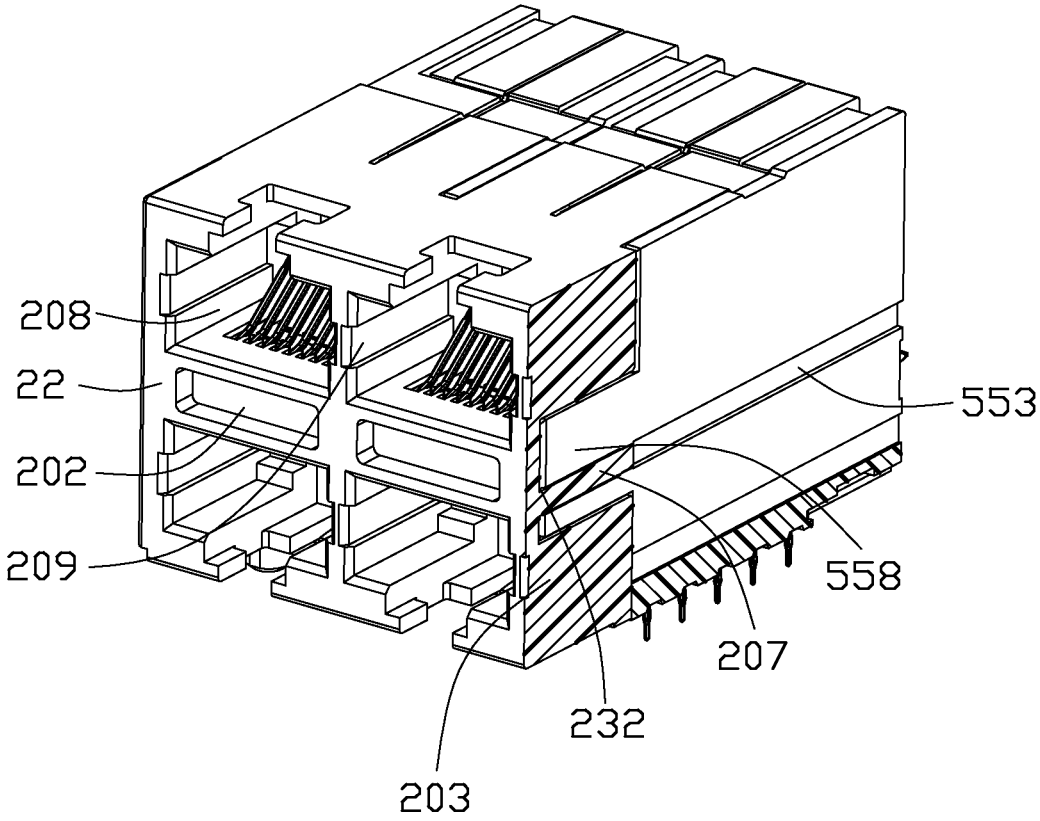
FIG. 14 is a cross-section view of the modular jack shown in FIG. 1, with the outer shell and the gasket removed.

Referring to FIGS. 12-14, each of the three shield modules 54 is disposed between two adjacent contact modules 400. The shield module 54 comprises a vertical shield 548 and a plastic body 55 over molding the vertical shield 548. The vertical shield 548 extends forwardly beyond the upper mating contacts 43 and the lower mating contacts 45, so that a more complete electrical shielding is formed between adjacent contact modules 400. The vertical shield 548 forms a plurality of ground tails 546 for electrically connecting the horizontal mother PCB 120 and a pair of project tips 549 extending rearward through the rear outer shell 128 and then riveted oppositely laterally to fix to the rear outer shell 128. The plastic body 55 has a front portion 558 inserted into the slots 232 of the insulating housing 200 (shown in FIG. 14).

The plastic body 55 defines a left slot 552 and a right slot 553 extending along a front-to-rear direction on opposite side. The left slot 552 mates a rib (not shown) of the housing and receives the right edge 431 of the upper PCB 43 (shown in FIG. 12). The right slot 553 mates a rib 207 of the housing and receives the left edge 451 of the lower PCB 45 (shown in FIGS. 12 and 14). The right edge 431 of the upper PCB 43 and the left edge 451 of the lower PCB 45 constitute protruding parts of the contact modules 400 accommodated in the slots 552, 553 of the plastic body 55. It is noted that the rib 207 protrudes from an inner side face of the slot 232 that is defined in the vertical wall 203 (shown in FIG. 14). The shield plate 548 is bent according to the shape of the left slot 552 and the right slot 553, so that the plastic body 55 could be easier for injection molding. The plastic body 55 further forms two ribs 556 extending along the front-to-rear direction and oppositely protruding below the contact modules 400, which helps to fix the contact modules 400 and provide a press force when the modular jack 100 is mounted onto the PCB 120.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack adapted to be mounted onto a horizontal mother printed circuit board (PCB), comprising:

a housing defining an upper cavity and a lower cavity vertically stacked under the upper cavity; and a contact module assembled to the housing and comprising:

an upper row of mating contacts extending into the upper cavity for mating with a modular plug inserted therein, a horizontal upper PCB bearing the upper row of mating contacts, a vertical first PCB electrically connecting the upper PCB, a plurality of first transferring contacts electrically connecting the first PCB to the mother PCB, a lower row of mating contacts extending into the lower cavity for mating with another modular plug inserted therein, a horizontal lower PCB bearing the lower row of mating contacts, a vertical second PCB electrically connecting the lower PCB, and a plurality of second transferring contacts electrically connecting the second PCB to the mother PCB.

2. The modular jack according to claim 1, wherein the first PCB defines an upper horizontal slot, the upper PCB having an edge received in the upper horizontal slot, and wherein the second PCB defines a lower horizontal slot, the lower PCB having an edge received in the lower horizontal slot.

3. The modular jack according to claim 2, wherein the first PCB has an interior surface on which a plurality of electronic components are mounted and an exterior surface on which a plurality of conductive pads are arranged along the horizontal slot, the conductive pads of the first PCB being electrically connected to the upper PCB.

4. The modular jack according to claim 1, wherein the contact module further comprises a bracket, the bracket comprising a vertical shield plate, a first plastic body and a second plastic body on opposite sides of the vertical shield plate, the first plastic body supporting the first PCB, the second plastic body supporting the second PCB.

5. The modular jack according to claim 1, wherein the contact module further comprises a front plastic body holding the upper PCB and the lower PCB.

6. The modular jack according to claim 5, wherein the contact module further comprises a center bracket supporting the first PCB and the second PCB, the bracket having a front slot receiving the upper PCB, the lower PCB and the front plastic body.

7. The modular jack according to claim 6, wherein the front slot has a pair of side walls, the side walls have protrusions laterally extending to a front of the first PCB and the second PCB, the protrusions mating with the front plastic body.

8. The modular jack according to claim 1, wherein the contact module comprises a horizontal shield plate disposed between the upper PCB and the lower PCB, and a vertical shield plate disposed between the first PCB and the second PCB and electrically connecting to the horizontal shield plate.

9. The modular jack according to claim 8, wherein one of said horizontal shield plate and said vertical shield plate defines a slot and the other is engaged in the slot.

10. The modular jack according to claim 8, wherein the vertical shield plate has a marginal edge beyond the marginal edges of the first PCB and the second PCB in all directions.

11. The modular jack according to claim 8, wherein the vertical shield plate has a plurality of ground tails extending downwardly for mating with the horizontal mother PCB.

12. The modular jack according to claim 8, wherein the vertical shield plate has a first arm electrically connecting the first PCB and a second arm electrically connecting the second PCB.

13. The modular jack according to claim 8, wherein the contact module further comprises a bottom plastic body holding the first transferring contacts and the second transferring contacts, the vertical shield plate downwardly extending through the bottom plastic body.

14. A modular jack adapted to be mounted onto a horizontal mother PCB, comprising:

a housing defining an upper cavity and a lower cavity vertically stacked under the upper cavity; and a contact module assembled to the housing; the contact module comprising:

an upper row of mating contacts extending into the upper cavity, a vertical first PCB electrically connecting the upper mating contacts, a plurality of first transferring contacts for electrically connecting the first PCB to the horizontal mother PCB, a lower row of mating contacts extending into the lower cavity, a vertical second PCB electrically connecting the lower mating contacts, a plurality of second transferring contacts for electrically connecting the second PCB to the horizontal mother PCB, a first plastic body supporting the first PCB, a second plastic body supporting the second PCB, and a vertical shield plate sandwiched between the second plastic body and the first plastic body.

15. The modular jack according to claim 14, further comprising an outer shell covering the housing and the contact module, the outer shell having a top wall, and the vertical shield plate has a top edge approximate the top wall of the outer shell.

16. The modular jack according to claim 14, further comprising an outer metal shell, and wherein the vertical shield plate forms a pair of projecting tips extending rearward through the outer metal shell, the pair of projecting tips being riveted oppositely for fixing the outer metal shell.

17. A modular jack comprising:

a housing defining plural pairs of upper and lower receiving cavities;

a plurality of contact modules disposed in the housing, each of said contact modules corresponding to each pair of upper and lower receiving cavities, each of said contact modules including an upper horizontal PCB (printed circuit board) and a lower horizontal PCB corresponding to the upper receiving cavity and the lower receiving cavity, a plurality of terminals connected to a front region of each of the upper horizontal PCB and the lower horizontal PCB for mating with respectively corresponding plugs, each of said contact modules further including a pair of vertical PCBs on two lateral sides; wherein said pair of vertical PCBs electrically and mechanically connect respectively to the corresponding upper horizontal PCB and lower horizontal PCB in a one-to-one condition.

18. The modular jack as claimed in claim 17, wherein the upper and lower horizontal PCBs connect to the corresponding pair of vertical PCBs directly under condition that one of the horizontal PCB and the corresponding vertical PCB defines a slot into which the other one extends to form a cross-like connection, and conductive pads on the horizontal PCB and those the corresponding vertical PCB around the cross-lie connection are linked with each other.

19. The modular jack as claimed in claim 17, wherein each contact module further includes around a vertical centerline a vertical shielding plate between the pair of vertical PCBs and mechanically and electrically connecting to the upper and lower horizontal PCBs.

20. The modular jack as claimed in claim 19, wherein each of said contact module further includes around a horizontal centerline a horizontal shielding plate between the upper and lower horizontal PCBs and mechanically and electrically connecting to the vertical shielding plate.

* * * * *